US006825419B2

(12) United States Patent
Grögl et al.

(10) Patent No.: US 6,825,419 B2
(45) Date of Patent: Nov. 30, 2004

(54) ELECTRIC CABLE FOR CONNECTION OF MOBILE ELECTRIC CONSUMERS

(75) Inventors: Ferdinand Grögl, Nuermberg (DE); Andreas Rietz, Nuermberg (DE); Thomas Mann, Weissenohe (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/658,420

(22) Filed: Sep. 10, 2003

(65) Prior Publication Data

US 2004/0050582 A1 Mar. 18, 2004

(30) Foreign Application Priority Data

Sep. 12, 2002 (DE) ..... 102 42 254

(51) Int. Cl.[7] ..... H01B 7/36

(52) U.S. Cl. ..... 174/112; 174/102 R; 174/103; 174/113 R; 174/116; 174/121 B; 174/107; 174/102 C

(58) Field of Search ..... 174/112, 102 R, 174/103, 113 R, 116, 121 B, 107, 102 C

(56) References Cited

FOREIGN PATENT DOCUMENTS

| | | |
|---|---|---|
| DE | 31 51 234 A1 | 6/1983 |
| DE | 33 26 986 C2 | 2/1985 |
| DE | 197 17 645 A1 | 10/1998 |
| DE | 197 29 646 C2 | 2/1999 |
| DE | 100 36 610 A1 | 2/2002 |
| WO | WO 99/44208 | 9/1999 |

*Primary Examiner*—Dean A. Reichard
*Assistant Examiner*—Jinhee Lee
(74) *Attorney, Agent, or Firm*—Sughrue Mion, PLLC

(57) ABSTRACT

An electrical cable (K) has at least two strands (1) consisting of insulated conductors (2) stranded together. Insulation on the strands (1) consists of an inner layer in contact with the conductor, and which is softer than an outer layer. The strands (1) are surrounded by an inner sheathing (6). The cable (K) also has an electric shield (7) and an outer sheathing (8). A separator layer (5) is between the strands (1) and the inner sheathing (6), consisting of an inner layer (6*a*, 6*b*) fixedly joined together with an outer layer (6*b*). The inner layer (6*a*) facing the strands (1) is softer than the outer layer (6*b*), having an approximately circular peripheral surface and in firm contact with the separator layer (5) or the strands (1). The electric shield (7) consists of at least one essentially closed tubular metallic layer and a stranded layer and/or braiding of metallic wires in contact with the metallic layer.

9 Claims, 1 Drawing Sheet

ELECTRIC CABLE FOR CONNECTION OF MOBILE ELECTRIC CONSUMERS

This application is based on and claims the benefit of German Patent Application No. 10242254.0 filed Sep. 12, 2002, which is incorporated by reference herein.

BACKGROUND OF THE INVENTION

This invention relates to an electric cable, for connecting mobile electric loads (current utilization devices), having at least two strands, each consisting of insulated conductors stranded together and having insulation consisting of layers arranged one above the other and fixedly bonded together, the inner layer being in contact with the conductor and being softer than the outer layer, with the strands surrounded by a common inner sheathing of insulation material which fills up outer gaps between the strands, and with an electric shield and an outer sheathing of insulation material also being present (as discussed in German Patent Application 100 36 610 A1).

Such cables are to be used as flexible cables for connecting portable devices having a voltage source and/or signal source. Such devices may include, for example, cranes, machine tools and robots. The cables must have a high load capability, must have a uniform bending fatigue strength over a long term and good flexibility over a broad temperature range, e.g., between −40° C. and +80° C.

With known cables of this type available on the market, the strands are surrounded by a loose inner sheathing of polyvinyl chloride (PVC) or polyurethane (PUR) which functions as filling. The strands are therefore relatively loose and may be damaged easily from the constant bending, back and forth, of the respective cable. With such inner sheathings, they are either not free of halogen and contain lead-based stabilizers (PVC) or they are not flame retardant (PUR), so that subsequent damage may occur in the event of a fire or the cables may quickly lose their functionality.

With the known cable according to the German Patent Application 100 36 610 A1 cited in the introduction, the softer inner layer of the strand insulation consists of a rubber-elastic material containing polypropylene, while the outer layer consists of a material based on polypropylene. The strands therefore have flexural strength even when subjected to repeated bending of the cable. They also have a good non-stick property, which supports their fatigue strength under reversed bending stresses. The inner sheathing, which surrounds the strands and functions essentially as filling, imparts increased stability to the cable if it also fills up the outer gaps between strands. The publication cited does not mention anything about the material of the inner sheathing or the type and arrangement of the electric shield.

SUMMARY OF THE INVENTION

The object of the present invention is to improve upon the cable described in the background, in particular with respect to its bending fatigue strength and its twistability combined with simplified fabrication.

This object is achieved according to this invention by providing a separator layer between the strands and the inner sheathing to ensure a relative mobility between the strands and the inner sheathing. The inner sheathing consists of two layers arranged one above the other and fixedly joined together, the inner layer of which, i.e., the layer facing the strands, is softer than the outer layer. The inner sheathing has an approximately circular peripheral surface and lies firmly against the separator, and thereby also indirectly against the strands. The electric shield arranged above the inner sheathing consists of at least one essentially closed tubular metallic layer and a stranded layer or braiding of metallic wires adjacent with the metallic layer, the outer sheathing being positioned above the shield.

This cable has a long-term bending fatigue strength, which is stable over the long run, so that it is particularly suitable for traversing long distances and withstanding frequent changes of direction in bending. Such requirements are frequently met in the case of machine tools. The strands themselves are designed with their special two-layer insulation with a softer layer on the inside for frequent changes in the direction of bending. On the whole, they are immovably secured radially in the inner sheathing, which fixedly surrounds the strands like a type of corset and therefore effectively protects them from the mechanical forces that occur in bending.

The separator layer applied between the strands and the inner sheathing, however, ensures that the inner sheathing is movable relative to the strands, so that the good bending properties of the cable are not impaired. Instead this yields a very good compensating movement of the strands between the upending and compression zones.

The good bending properties of the cable are also supported by the design of the inner sheathing, which consists of two layers of different hardness fixedly joined together, the softer layer of which faces the strands. This structure of the inner sheathing also allows an especially simple fabrication of the cable. As circumstances require, only the outer harder layer of the inner sheathing need be severed. It can then be torn away easily at the separation point without any risk of damage to the strands because the separator layer is provided between them and the inner sheathing.

Regardless of the number of strands, the inner sheathing has an approximately circular peripheral surface. It thus provides a fixed and uniform substrate for the electric shield of the cable and its outer sheathing of insulation material situated above same. The electric shield consisting of at least one metallic layer, which is closed on all sides and a cabled covering/braiding adjacent thereto, is electrically impervious even at higher frequencies. Therefore, no interfering radiation can be emitted by the cable, and the cable itself is effectively protected from foreign fields.

BRIEF DESCRIPTION OF THE DRAWINGS

Exemplary embodiments of the subject matter of the invention are illustrated in the drawings, including.

DETAILED DESCRIPTION OF THE INVENTION

Figure 1:
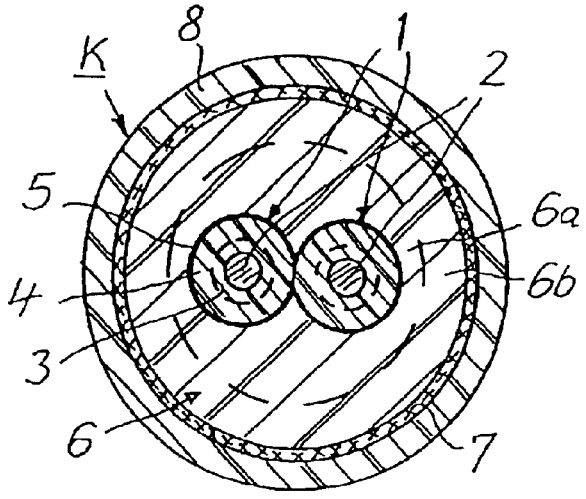
FIG. 1 which shows a cross section through a cable according to this invention in a schematic diagram.

The electric cable K according to FIG. 1 has two strands 1, which are stranded together. Each strand 1 consists of a metallic electric conductor 2, which is surrounded by insulation and is composed of two layers 3 and 4, one situated above the other. The inner layer 3, which is adjacent to the conductor 2, consists of a softer material than the outer layer 4. The two layers 3 and 4 are fixedly joined together. The strands 1 may be used to transmit power or signals. They may therefore also have different dimensions. The strands 1 and their conductors 2, preferably made of copper, are shown only in general terms in this sense.

The layers 3 and 4 of the strand insulation are preferably made of materials that bond directly to the conductor 2 when applied to same. This may be achieved, for example, by extrusion in a tandem method or by co-extrusion of the two layers 3 and 4. The softer inner layer 3 preferably has a higher elastic material content in comparison with the outer layer 4. It may essentially be a rubber-elastic material such as ethylene-propylene rubber, but it may also advantageously be an elastomer or a material having elastomer-like properties.

The strands 1 are surrounded by a separator layer 5, which is made of stearate or cellulose, for example. Both materials may be present in the form of powders and may be applied, e.g., by electrostatic charging to the insulation of the strands 1. To do so, the respective powder may itself be charged. However, it is also possible to build up an electrostatic charge in the strands 1. In this way, the powders can be applied very uniformly to the strands 1 to form the separator layer 5.

Above the separator layer 5 there is an inner sheathing 6 of insulation material, which is produced by extrusion in the usual technique. Thus, the separator layer lies between the inner sheathing 6 and the strands 1. Due to the heat prevailing in the material of the inner sheathing 6, the material of the separator layer 5 is preferably bonded to the inner sheathing 6 so that the separator layer 5 is also removed whenever the inner sheathing 6 is removed. At the same time, the material of the separator layer 5 is influenced in application of the inner sheathing 6, so that the same good non-stick properties are obtained. For example lead-free PVC or a halogen-free polyolefin compound based on polyethylene or a copolymer thereof can be cited as suitable examples of materials for the inner sheathing 6. The inner sheathing 6 should preferably be elastic enough to be compressible in twisting of the cable K in particular.

The inner sheathing 6 consists of two layers 6*a* and 6*b*, one on top of the other, bonded together fixedly in application. This can again be achieved by tandem extrusion or co-extrusion. As in the case of the insulation of the strands 1, the inner layer 6*a*, which is in contact with the separator layer 5 and, thus, indirectly with the strands 1, is softer than the outer layer 6*b*. It advantageously also has a lower strength than the outer layer 6*b*. This can be achieved through appropriate dosing of elastic materials. The outer layer 6*b* may also be foamed to improve its compressibility and thus the elastic properties of the inner sheathing 6. Such an inner sheathing 6 can be removed more easily from the strands 1, e.g., for connection purposes. As mentioned above, only the outer layer 6*b* need be severed with a round cut to this end. The inner sheathing 6 together with the separator layer 5 may then be torn away at the separation point.

Figure 3:
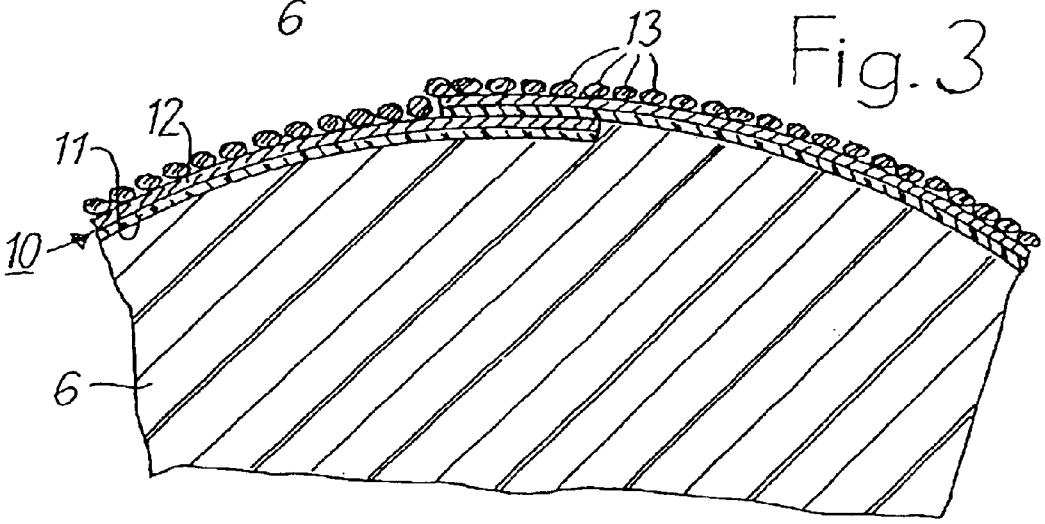
FIG. 3 which shows a cross section through an electric shield, which can be used in the cable, shown in an enlarged diagram.

Regardless of the number of strands 1 and their more or less uniform sheathing, the inner sheathing 6 has an approximately circular peripheral surface. The peripheral surface is thus most suitable as a contact surface for additional layers of the cable K. An electric shield 7, the structure of which is shown in FIG. 3, for example, is situated above the inner sheathing 6. The shield 7 is surrounded by an outer sheathing 8 of insulation material, consisting of polyurethane, for example. Between the shield 7 and outer sheathing 8, a separator layer glued to same may be situated between them, e.g., an overlapping, longitudinally shrinkable fiber band.

For simple identification of the cable K, the inner sheathing 6 may have a defined color, which differs in a clearly perceptible manner from the colors of the other elements of the cable K. Then if the inner sheathings 6 are of different colors, cables K that are otherwise essentially identical may easily be assigned to certain users and/or certain applications.

Figure 2:
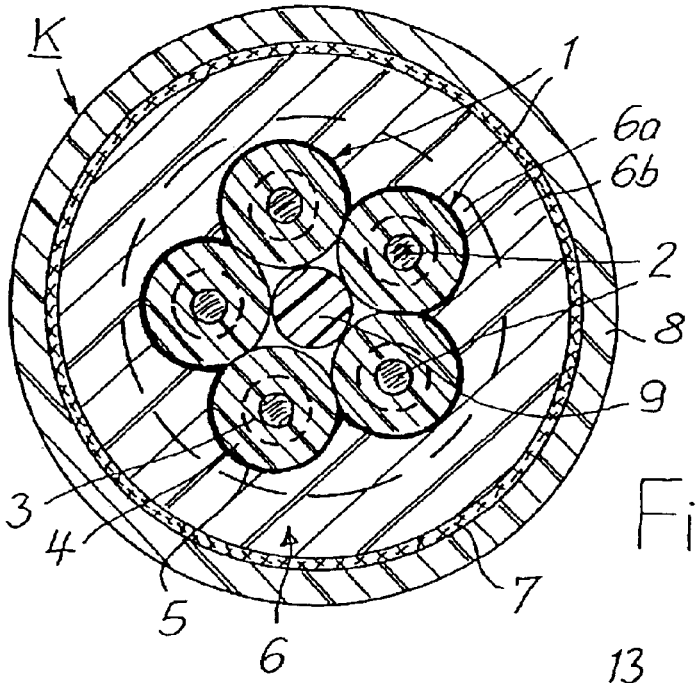
FIG. 2 which shows an embodiment of the cable, which has been supplemented in comparison with FIG. 1.

If the cable K has more than two strands 1, e.g., five strands according to FIG. 2, they are preferably stranded around a central carrier 9, which functions as a supporting element. The carrier 9 may be a fiber or a plastic cord. It may also be finished with an element having tensile strength or it may have its own tensile strength. For the structure of the cable K situated above the strands 1 according to FIG. 2, the same thing holds as for the cable K according to FIG. 1.

The shield 7 according to FIG. 3 has a ribbon 10 consisting of at least one metallic layer 12 fixedly bonded to a plastic carrier 11. A nonwoven material, such as fleece, which is capable of elastic yield and withstanding bending and torsional stresses in particular without any risk of damage, is preferred for use as the material of the plastic carrier 11. The nonwoven material is "metallized" to form the layer 12, for example. The ribbon 10 may be wrapped with overlapping, longitudinally shrinkable edges around the inner sheathing 6 so as to yield an essentially closed tubular shell. A stranded layer and/or braiding of metallic wires 13 is applied over the ribbon 10 having the metallic layer 12 on the outside. The wires 13 are preferably made of copper. The stranded layer and/or braiding should have a visual coverage of greater than 90%.

Although the very narrow gap in the overlap area of the ribbon 10 should be completely impervious electrically, it is expedient to use a ribbon whose plastic carrier 11 has a metallic layer 12 on both sides. Here again, a nonwoven material is preferably used for the plastic carrier 11. In this embodiment of the cable K, the ribbon 10 is preferably situated between two layers of wires 13, which accordingly form two stranded layers and/or braidings in the shield 7. The shield therefore has an increased transverse conductivity.

The metallic layers 12 are preferably made of copper. For example, tin-plated copper wires may be used as the wires 13.

What is claimed is:

1. An electric cable for connecting mobile electric loads having at least two strands comprising insulated conductors stranded together, each of the at least two strands having an insulation comprising two layers which are arranged one above the other and fixedly bonded together, an inner layer of the two layers being adjacent to the conductor and softer than an outer layer; the at least two strands being surrounded by a common inner sheathing of insulation material which fills up outer gaps between the at least two strands; an electric shield; and an outer sheathing of insulation material, wherein a separator layer (5) is provided between the at least two strands (1) and the common inner sheathing (6), ensuring a relative mobility between the at least two strands (1) and the common inner sheathing (6), wherein the common inner sheathing (6) consists of two layers (6*a*, 6*b*) arranged one above the other and fixedly joined together, the inner layer (6*a*) facing the strands (1), and being softer than the outer layer of the common inner sheathing (6*b*), wherein the common inner sheathing (6) has an approximately circular peripheral surface and lies firmly against the separator layer (5), respectively, and wherein the electric shield (7) which is arranged above the common inner sheathing (6) comprises at least one essentially closed tubular metallic layer (12) and a stranded layer or braiding of metallic wires (13) situated in contact with the metallic layer (12), the outer sheathing (8) being positioned above the electric shield (7).

2. The cable according to claim 1, wherein the separator layer (5) comprises stearate.

3. The cable according to claim 1, wherein the separator layer (5) comprises cellulose.

4. The cable according to claim 1, wherein the metallic layer (12) is fixedly joined to a plastic carrier (11) to form a ribbon (10) which is formed around the inner sheathing (6) with overlapping edges so that the metallic layer (12) is on the outside, and the metallic wires (13) are applied around the ribbon (10).

5. The cable according to claim 1, wherein two metallic layers are fixedly joined to a plastic carrier (11) to form a ribbon (10), each on one side of same, and the ribbon (10) is applied with overlapping edges between two layers of metallic wires formed around the inner sheathing (6).

6. The cable according to claim 4, wherein the plastic carrier (11) is a fleece.

7. The cable according to claim 5, wherein the plastic carrier (11) is a fleece.

8. The cable according to claim 1, wherein, when the at least two strands are three or more strands (1), there is a central carrier (9) made of an insulation material around which the three or more strands (1) are laid.

9. The cable according to claim 1, wherein the inner sheathing (6) has a defined, clearly recognizable color.

* * * * *